US005985448A

United States Patent [19]

Koenig

[11] Patent Number: 5,985,448

[45] Date of Patent: Nov. 16, 1999

[54] OPEN CROSS-SECTIONAL WIRE

[76] Inventor: Erl A. Koenig, 108 Stone Camp Way, Averill Park., N.Y. 12108

[21] Appl. No.: 08/810,697

[22] Filed: Mar. 3, 1997

[51] Int. Cl.[6] ..... D02G 3/00

[52] U.S. Cl. ..... 428/397; 428/364; 428/375; 428/379; 428/399; 174/102 SP; 174/126.3; 174/138 A

[58] Field of Search ..... 428/364, 375, 428/379, 385, 397, 399; 174/102 SP, 126.3, 138 A

[56] References Cited

U.S. PATENT DOCUMENTS

| | | |
|---|---|---|
| 1,797,289 | 3/1931 | Kotochi . |
| 1,804,076 | 5/1931 | Arutunoff . |
| 2,097,707 | 11/1937 | Tichenor . |
| 2,203,760 | 6/1940 | Wilckens . |
| 2,417,785 | 3/1947 | Slepian . |
| 2,433,181 | 12/1947 | White . |
| 3,866,015 | 2/1975 | Matsumoto et al. . |
| 4,632,506 | 12/1986 | Taylor . |

FOREIGN PATENT DOCUMENTS

| | | |
|---|---|---|
| 0408597 | 1/1925 | Germany . |

*Primary Examiner*—William Krynski
*Assistant Examiner*—J. M. Gray
*Attorney, Agent, or Firm*—Klauber & Jackson

[57] ABSTRACT

A wire having an open cross-sectional shape which is responsive to induced fields.

11 Claims, 1 Drawing Sheet

OPEN CROSS-SECTIONAL WIRE

This Application is based on the Disclosure Document No. 371352 filed with the U.S. Patent and Trademark Office on Mar. 2, 1995 which is incorporated in its entirety as if fully set out herein.

BACKGROUND OF THE INVENTION

The present invention relates to wires generally and, more particularly, but not by way of limitation, to a novel open cross-sectional wire.

DESCRIPTION OF THE RELATED ART

Electrically conductive material or wire with a continuous peripheral surface skin has magnetic flux circulating around the conductor when electrified. The circulating magnetic flux surrounds the conductor regardless of cross-sectional shape. Moreover, a radial torque motion is associated with the conductor or electric transmission line. The torque motion corresponds to the type of electrification, e.g. alternating current or direct current. The radial torque motion is manifested as a mechanical force that promotes premature material degradation by heating. Radial motion prematurely decomposes insulation coating, such as with magnet wire used for solenoids. Transmission line wire is usually solid and round shaped, although, solenoid magnet wire may be produced in solid, hollow, round, oval, square and rectangular crosssection shapes.

All electrically conductive materials have their own characteristic impedance, i.e. the value of resistance that electricity has during electrification.

It is an object of the invention to reduce and improve the characteristic impedance of a material so a desired amount of electrically conductive material can withstand greater electrification.

For example, if a 100 circular mil wire of prior art cross section and traditional shape can withstand 10 ampere of electrification, it is an object of the present invention to greater than 10 ampere of electrification.

It is another object of the invention to reduce and improve the temperature heat rise associated with the electrification of electrically conductive material.

A further object of the invention is to increase the life span of electrically conductive material thereby reducing service and maintenance costs.

An additional object of the invention is to constructively improve magnetic eddy current decay time which is a function of characteristic impedance.

SUMMARY OF THE INVENTION

The present invention achieves the above objects, among others, by providing, in a particular embodiment, a wire having an open cross-sectional shape. The wire may have a core provided with a longitudinal slot. In one embodiment the longitudinal slot extends approximately halfway into the core. The wire may alternately include a tubular wall having an outer surface and an inner surface. The inner surface defines an internal cavity. The tubular wall is further provided with a longitudinal slot which connects with the internal cavity.

The wire is capable of being electrified. The electrification induces a magnetic flux, and the open cross-sectional shape varies in response to the magnetic flux generated by the electricity.

Other objects of the present invention, as well as particular features, elements, and advantages thereof, will be elucidated in, or be apparent from, the following description and the accompanying drawing figures.

BRIEF DESCRIPTION OF THE DRAWINGS

Understanding of the present invention and the various aspects thereof will be facilitated by reference to the accompanying drawings figures, submitted for purposes of illustration only and not intended to limit the scope of the invention, in which.

DETAILED DESCRIPTION OF THE PREFERRED EMBODIMENT

Figure 1:
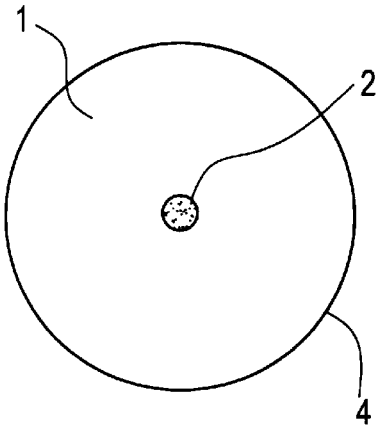
FIG. 1 PRIOR ART
FIG. 1 shows an energy transmitting conductor material 1 having a round cross-sectional shape with a centrally inside location 2 and outside location 4. (PRIOR ART).
Figure 2:
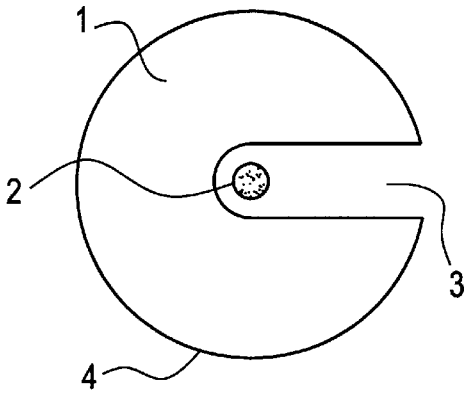
FIG. 2 shows an energy transmitting conductor material 1 having a round cross-sectional shape with an opening 3 from centrally inside location 2 to the outside location 4.
Figure 3:
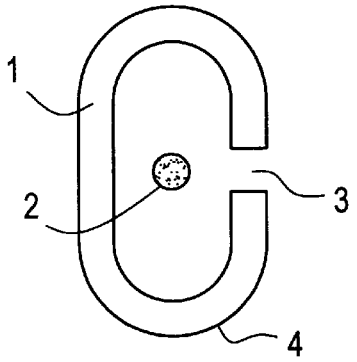
FIG. 3 is a conductor having an oval cross-section shape.
Figure 4:
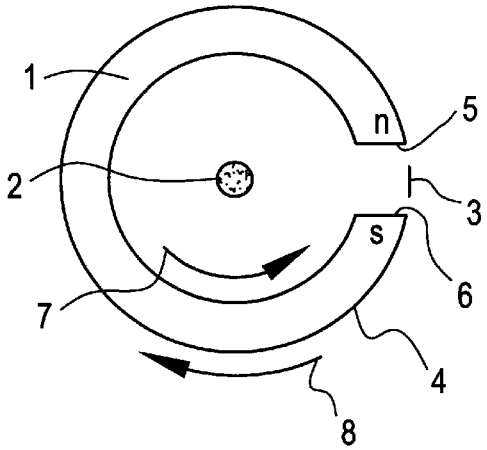
FIG. 4 shows an energy transmitting conductor material 1 having a round cross-sectional shape with an opening 3 from centrally inside 2 to the outside 4 whereby the first opening face 5 is a north pole and the second opening face 6 is a south pole and the opposite poles 5 and 6 result from inside circulating flux direction 7 being opposite to outside circulating flux direction 8.
Figure 5:
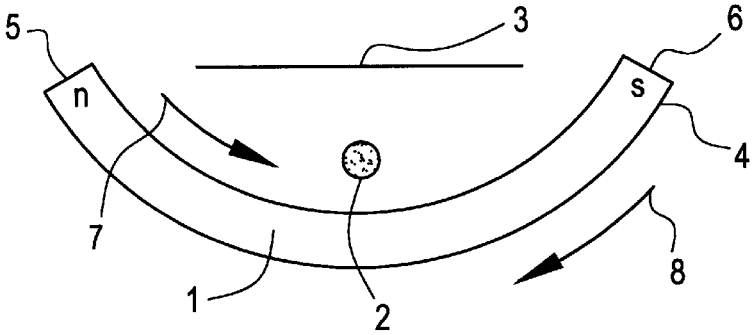
FIG. 5 shows an opening 3 such that the north pole face location 5 and south pole face location 6 becomes evident because of an opening 3 from centrally inside 2 to outside 4.

Because characteristic impedance for a particular material can be constructively improved, benefits are realized for eddy current decay time, energy efficiency, heat rise, hysteresis loss, material life, counter EMF, electric acceleration, distortion, vibration and economics.

The present invention has a novel cross-section shape for a material that transmits and receives energy.

Two space facing surfaces created by the opening are such that flux polarity becomes evident at the two surfaces. An optimum condition is when the cross section shape and opening prevent the material from becoming saturated for a desired input and load requirement.

The polarity at the opening faces result from the flux direction being opposite on the materials inside surface to that on the materials outside surface.

In the accompanying Figures, the following elements are generally shown: conductor material cross section characteristic impedance 1; centrally inside location 2; opening from centrally inside location to the outside location 3; outside location 4; north pole face location 5; south pole face location 6; conductor inside surface flux direction 7; and conductor outside surface flux direction 8.

Manufacturing a transmission line in accordance with the invention can be accomplished by various methods employing optional techniques. The open from centrally inside to outside conductor was accomplished by sawing a slot 0.010" wide along a copper tube with an outside diameter of 0.062"×0.038" inside diameter.

In one embodiment, fabricating conductor specimens with identical material and cross section area was used to establish comparison values for the opening from centrally inside to the outside shape. Two identical copper tubes were sawed open along the length axis. One tube remained open which created a "C" shape. The second tube was squeezed closed to create a shape with an unopened outside skin. This technique resulted in comparing identical conductor cross section for the two specimens.

Temperature heat rise was the characteristic measured. When specimens were positioned between a 110 volt alternating current source and a 1500 watt inductive load, the opened specimen heat rise was 122 degrees F while the closed specimen heat rise was 127 degrees F.

The investigation showed that the "C" shape influenced the conductor material element nobility and constructively improved the conductor material characteristic impedance. Further, the slotted opening created a north pole at the flux entering the face of the opening and a south pole at the flux exiting opposite face of the opening. The circulating flux surrounding the energized "C" shaped material changes the opening dimension in correspondence with energy frequency changes.

Thus, electric transmission line characteristic impedance is constructively improved when the physical cross-section is open from centrally inside to the outside.

Various embodiments of the present invention include, but are not limited to the following: utility electric power cable; electric wire conductor; telephone and communication wire; coaxial center conductor; bus bars; antenna (transmit-receive); printed circuitry; solenoid magnet wire; and lamp filaments.

What is claimed is:

1. An electric transmitting and receiving conductor where the material cross sectional shape of the conductor is oval; said conductor having a longitudinal slot from centrally inside the conductor to the outside of the conductor and extending along the length thereof.

2. The conductor according to claim 1 where the material is copper.

3. A conductor according to claim 1 where the opening changes dimension in correspondence with electric changes.

4. A conductor material of cross section shape having an opening from centrally inside to the outside, that when energized will possess magnetic polarity at the open materials faces.

5. An electric conductor for transmission of an alternating current comprising:

a wire having a length and a outer surface;

said wire being conductive of alternating current and having an inner surface defining a hollow interior along said length;

said outer and inner surfaces having a generally oval cross sectional shape;

a gap formed along the length of said wire creating opposing faces that interconnect the inner and outer surfaces of wire;

whereby said outer and inner surface of said wire to conduct said alternating current;

said opposing faces when transmitting said current forming opposing magnet poles on said faces.

6. The conductor of claim 5 wherein said gap is formed generally equidistant from the foci that define said oval shape.

7. The conductor of claim 6 wherein said conductor is non-magnetic.

8. The conductor of claim 7 wherein said conductor is copper.

9. The conductor of claim 8 wherein said wire is in a electric utility power cable.

10. The conductor of claim 8 wherein said wire is in a telephone and communications wire.

11. The conductor of claim 8 wherein said wire is a center conductor of a coaxial cable.

* * * * *